US006772782B2

(12) United States Patent
Bogan et al.

(10) Patent No.: US 6,772,782 B2
(45) Date of Patent: Aug. 10, 2004

(54) CABLE ROUTING IN WASTEWATER LIFT STATION

(75) Inventors: Timothy D. Bogan, Roseburg, OR (US); Mark Sheldon, Coos Bay, OR (US); David B. Bogan, Laughlin, NV (US); Sarah B. Bogan, Roseburg, OR (US)

(73) Assignee: Romtec Utilities, Inc., Roseburg, OR (US)

( * ) Notice: Subject to any disclaimer, the term of this patent is extended or adjusted under 35 U.S.C. 154(b) by 0 days.

(21) Appl. No.: 10/700,807

(22) Filed: Nov. 3, 2003

(65) Prior Publication Data

US 2004/0089345 A1 May 13, 2004

Related U.S. Application Data

(63) Continuation of application No. 09/951,662, filed on Sep. 10, 2001, now Pat. No. 6,644,342.

(51) Int. Cl.[7] ..... E03B 9/00

(52) U.S. Cl. ..... 137/15.01; 137/364; 137/371; 137/560; 52/21

(58) Field of Search ..... 137/15.01, 364, 137/371, 560; 52/21

(56) References Cited

U.S. PATENT DOCUMENTS

| | | | | |
|---|---|---|---|---|
| 2,217,097 A | * | 10/1940 | Brooks | 220/324 |
| 2,497,969 A | * | 2/1950 | Anderson | 62/50.2 |
| 2,832,614 A | | 4/1958 | Settle, Jr. | |
| 3,112,760 A | | 12/1963 | Budd | |
| 3,375,788 A | | 4/1968 | Solas et al. | |
| 3,461,803 A | * | 8/1969 | Stothoff et al. | 417/36 |
| 3,525,353 A | | 8/1970 | Parks | |
| 3,810,261 A | | 5/1974 | Hollander | |
| 3,891,224 A | | 6/1975 | Ditcher | |
| 3,938,545 A | * | 2/1976 | Nagy et al. | 137/363 |
| 3,980,311 A | | 9/1976 | Ditcher | |
| 4,023,590 A | | 5/1977 | Harris et al. | |
| 4,253,282 A | | 3/1981 | Swartz | |
| 4,340,081 A | * | 7/1982 | Watson | 137/364 |
| 4,472,911 A | | 9/1984 | Jooris et al. | |
| 4,540,310 A | | 9/1985 | Ditcher et al. | |
| 4,706,718 A | * | 11/1987 | Milo | 141/86 |
| 4,865,526 A | * | 9/1989 | Clark et al. | 417/360 |
| 4,867,871 A | | 9/1989 | Bowne | |
| 5,076,456 A | | 12/1991 | Geyer | |
| 5,423,447 A | | 6/1995 | Youngs | |
| 5,435,664 A | | 7/1995 | Pettersson | |
| 5,542,780 A | | 8/1996 | Kourgli | |
| 5,544,460 A | | 8/1996 | Fife | |
| 5,617,679 A | | 4/1997 | Meyers | |
| 5,658,135 A | | 8/1997 | Sodergard | |
| 5,826,887 A | | 10/1998 | Neumann et al. | |
| 5,924,846 A | | 7/1999 | Arnold, Jr. et al. | |
| 5,934,315 A | | 8/1999 | Braswell et al. | |
| 6,047,724 A | | 4/2000 | Nurse, Jr. | |
| 6,644,342 B1 | * | 11/2003 | Bogan et al. | 137/364 |

OTHER PUBLICATIONS

Tipton Environmental International Inc., Lift Station, www.tipton.org/lift station2.html, pp. 1–2, 2000.

* cited by examiner

*Primary Examiner*—A. Michael Chambers
(74) *Attorney, Agent, or Firm*—Klarquist Sparkman, LLP

(57) ABSTRACT

A modular well for a wastewater lift station includes multiple well sections. Each of the well sections has at least one mating feature allowing it to be joined to at least one other well section and to form a liquid tight seal. The well is formed by vertically mating the well sections together. One of the well sections has an inlet opening, and the same or a different well section has at least one outlet opening.

17 Claims, 3 Drawing Sheets

CABLE ROUTING IN WASTEWATER LIFT STATION

CROSS-REFERENCE TO RELATED APPLICATION

This application is a continuation of prior copending U.S. patent application Ser. No. 09/951,662, filed on Sep. 10, 2001, now U.S. Pat. No. 6,644,342, which is incorporated herein by reference.

BACKGROUND

Wastewater lift stations, which lift wastewater from one elevation to a higher elevation to facilitate moving downstream by gravity, are generally known.

In a typical lift station assembly, an in-ground well receives wastewater, such as sewage, through an inlet in a side wall of the well. The wastewater accumulates within the well until it reaches a predetermined level, at which point a submersible pump or other wastewater moving device in the well is automatically triggered to begin evacuating wastewater through an outlet in the side wall located at an elevation above the inlet.

The pump continues operating until the level of accumulated wastewater in the well decreases to a second predetermined level. The elevation of the outlet may be sufficient to allow the evacuated wastewater to flow by gravity, e.g., via a sewer main to a municipal wastewater treatment plant.

Conventionally, most wastewater lift stations have been custom designed and engineered for a particular facility, with the lift station requiring extensive fitting, fabrication and assembly on site. Custom designs and any extended on-site activity require additional time and personnel with substantial experience and/or special certifications, both of which increase costs.

Conventional lift stations not designed according to a modular approach frequently include components, whether specially fabricated or off-the-shelf products from suppliers, that have not been used or used together in a lift station. Attempts to assemble these components on-site often reveal incompatibility and performance problems. Even a minor on-site problem can cause unpredictable and costly delays. Incompatibility problems that are not discovered initially require expensive service visits and may result in costly system failures.

SUMMARY

A modular, integrated wastewater lift station has components which are pre-configured to reduce on-site installation time and to avoid potential component incompatibility problems. Certain components are available in a selected, but finite range of sizes to suit a great majority of different applications that may be commonly encountered.

The well is constructed from pre-formed well sections, and includes a bottom well section, one or more intermediate well sections, and a top well section. The depth of the well can be set as desired by selecting an appropriate number of intermediate well sections, which are positioned on top of each other and on top of the bottom well section that has been placed at an appropriate elevation (e.g., at the bottom of an excavated hole). The top well section is mated with the top of the uppermost intermediate well section and covers the well.

The well sections are pre-fabricated at the factory to include some components and have features for receiving other components. Some of these features may, e.g., help to avoid the need to align and drill holes on-site to attach components.

Installation is simplified, as little on-site fabrication or changes to the basic design of the lift station is required. Installation can be completed more quickly and with more assurance, since there is less chance of encountering a problem or failing to fully configure any of the components.

DETAILED DESCRIPTION

A modular lift station assembly includes a well that receives and stores wastewater, a wastewater moving device operable to evacuate the wastewater within the well and a wastewater moving device control circuit that provides control signals to the wastewater moving device. In addition to wastewater, the lift station assembly can be used to evacuate storm water or in other applications where a collected body of liquid needs to be elevated against the force of gravity.

The well comprises multiple mating sections, including at least a bottom sump section and a top cover section, together with one or more intermediate sections positionable between the sump section and the cover section. When assembled, the well sections are sealingly engaged with each other and form the well.

The well has an inlet through which wastewater is received and at least one outlet through which wastewater is evacuated. When the well sections are assembled, the outlet (s) is at an elevation above the inlet. The inlet and outlet(s) may be formed in the same well section, or in different well sections, depending upon the geometry of the particular application.

The wastewater moving device, which may be, e.g., at least one submersible pump positioned in the well, is controlled to operate and evacuate accumulated wastewater from within the well upwardly and out through the outlet(s). In typical installations, two submersible pumps are used for redundancy (i.e., in the event that one pump fails or requires maintenance) and for increased pumping capacity (i.e., both pumps can be operated simultaneously in the event of a heavy load), although a single pump could also be used.

A valve vault that houses preassembled valves and connecting pipe sections for placement downstream of and connection to the outlet(s) of the lift station may also be provided.

Well

Figure 1:
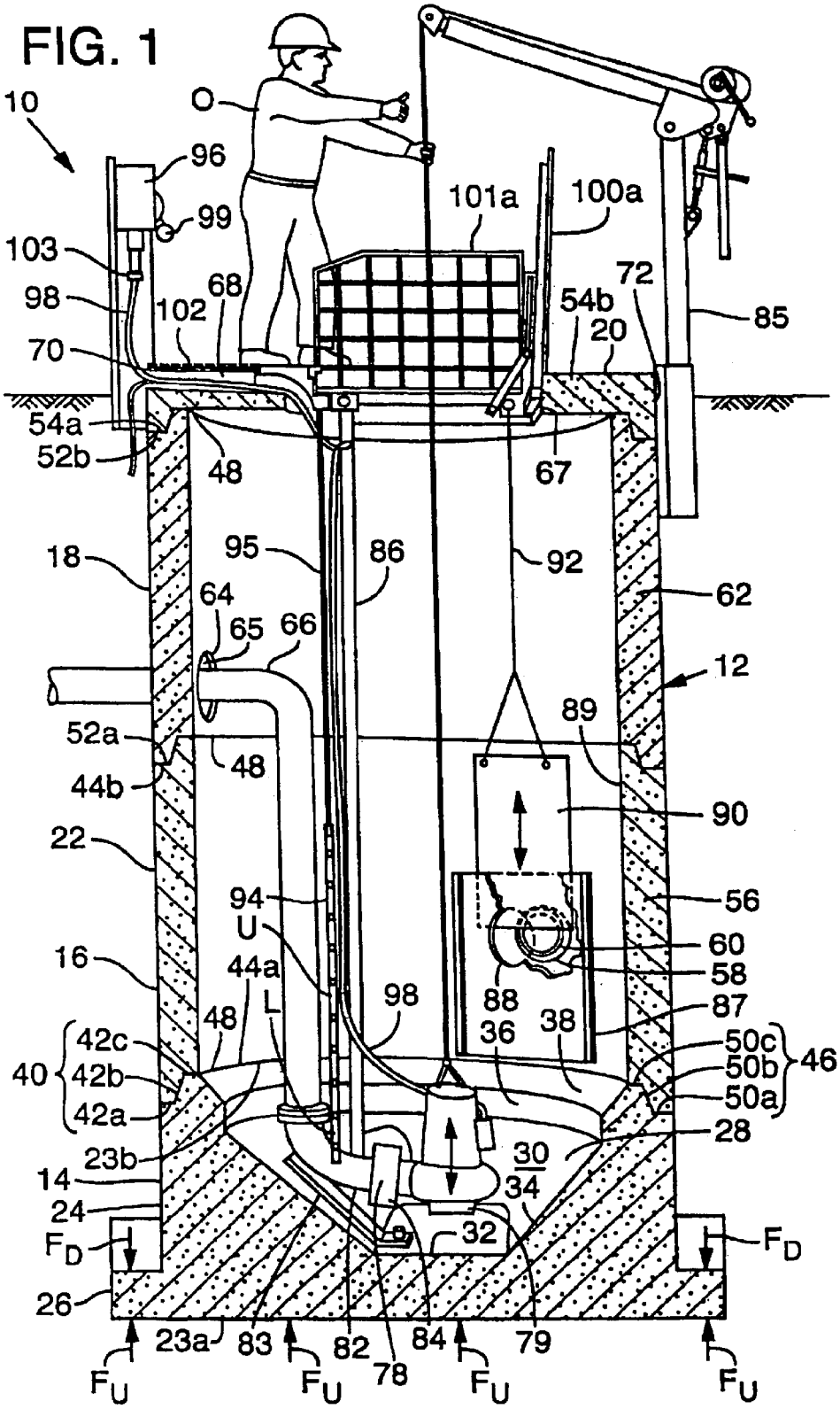
FIG. 1 is a vertical cross section of a lift station assembly, showing a front side of one implementation for a typical installation in an excavated hole.
Figure 2:
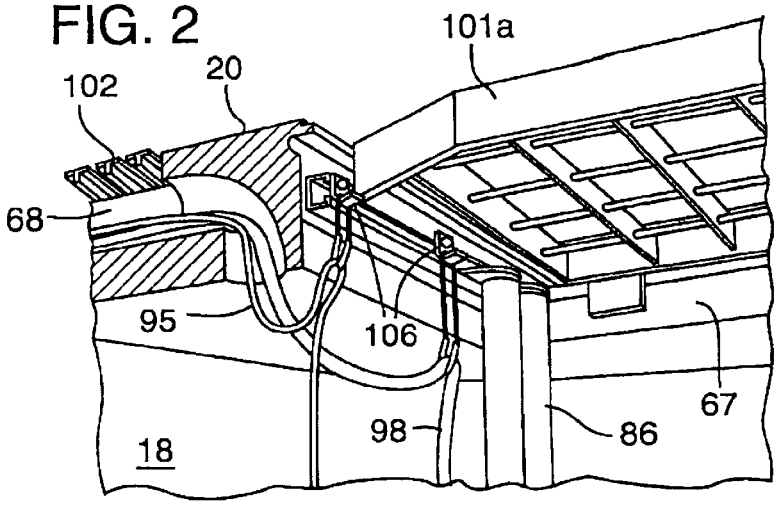
FIG. 2 is a partial oblique view showing a lower end of a top cover well section of the lift station assembly of FIG. 1.

In a specific implementation, as shown in FIG. 1, a lift station assembly 10 has a generally in-ground wet well 12 formed of multiple modular well sections 14, 16, 18 and 20 that have been assembled together end-to-end with a gasket 48 between each adjacent pair of well sections. As illustrated, each of the well sections 14, 16, 18 and 20 has a generally circular outer periphery, such that the assembled well 12 has a generally circular cylindrical outer surface 22.

Figure 3:
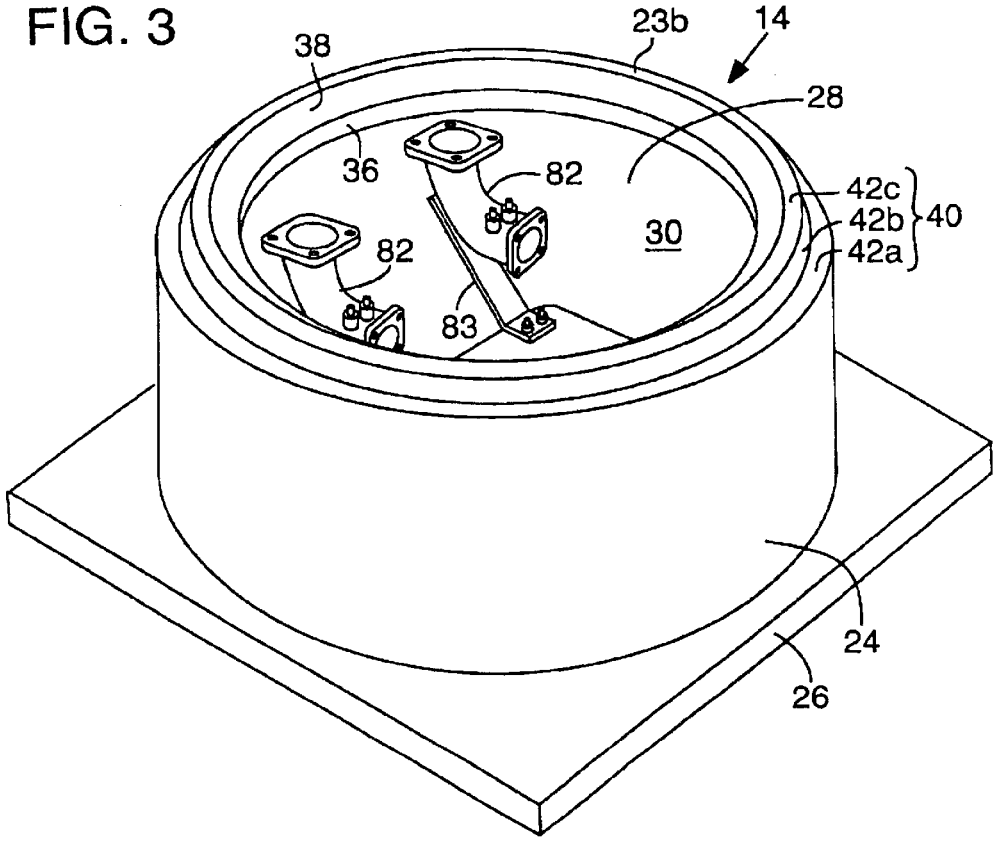
FIG. 3 is an oblique view showing the two pump positions in a bottom sump well section of the lift station assembly of FIG. 1.

The well section 14, referred to herein as the bottom sump well section, has an outer surface 24 and a lower end 23*a* that forms a base of the well 12. As illustrated in FIGS. 1 and 3, an external edge 26 of the lower end 23*a* extends laterally outward beyond the outer surface 24.

The lower end 23*a* may be square as shown or rectangular. Under some conditions, e.g., in soil saturated with groundwater as frequently found in coastal locations, significant uplifting forces ($F_U$) urging the wet well 12 upward are experienced. One way to reduce this effect is to provide a substantial surface area adjacent the bottom of the wet well 12 and against which the same forces can act in the opposite (i.e., downward) direction to counteract the uplifting forces (as shown by the arrows $F_D$). In other words, the forces $F_D$ on the upper side of the lower end 23*a* between the outer surface 24 and the external edge 26 are substantially the same in magnitude as the forces $F_U$ on bottom surface, but the forces $F_D$ act in the opposite direction and thus counteract at least a portion of the uplifting forces $F_U$. Although a circular lower end could be used, a square or rectangular lower end provides more counteracting surface area than a circular lower end having approximately the same major dimension from the standpoint of required storage or transportation space.

FIGS. 1 and 3 show an inner surface 28 of the bottom sump section 14 that defines an interior or sump 30 having a generally level bottom surface 32, a sloping first side surface 34 extending upward from the bottom surface 32, a generally vertical second side surface 36 extending upward from the first side surface 34 and a sloping third side surface 38 extending from the second side surface 36 to an upper end 23*b*. As illustrated in FIG. 1, the sump 30 has an inverted, generally frustoconical shape.

As best illustrated in FIGS. 1 and 3, the upper end 23*b* of the bottom sump section 14 is formed with an engagement feature, e.g., a peripheral two-level rim 40, configured to engage a corresponding feature on an adjacent well section when assembled. The two-level rim 40 has a generally flat outer rim 42*a* at a first level, a sloping connecting surface 42*b* extending upward from the outer rim 42*a* and a generally flat inner rim 42*c* extending from the connecting surface 42*b* that forms part of the upper end 23*b*.

As illustrated in FIG. 1, the lower intermediate well section 16 is a hollow cylinder having a bottom end 44*a* formed with a two-level lip 46 shaped to engage the two-level rim 40. The gasket 48 is positioned between the two-level rim 40 and the two-level lip 46 to provide a fluid tight seal between the bottom sump well section 14 and the lower intermediate well section 16 in the assembled well 12.

The gasket 48 is preferably made of rubber, but may be made of any material that is capable of withstanding contact with gases, liquids, and solid material that may reside within the well 12. Possible gasket materials include, but are not limited to, rubber, Neoprene™, Teflon™, and Kevlar™.

The two-level lip 46 has a generally flat outer lip 50*a* at the bottom end 44*a*, a sloping connecting surface 50*b* extending upward from the outer lip 50*a* and a generally flat inner lip 50*c* extending from the connecting surface 50*b* at a level above the outer lip 50*a*. The lip 46 is dimensioned such that the inner lip 50*c*, the gasket 48 and the inner rim 42*c* form a fluid tight seal when the lower intermediate well section 16 is rested upon the bottom sump well section 14.

As shown in FIG. 1, upper ends 44*b* and 52*b* of the lower intermediate well section 16 and upper intermediate well section 18, respectively, each have a two-level rim similar to the rim 40. Similarly, lower ends 52*a* and 54*a* of the upper intermediate well section 18 and the well section 20, respectively, each have a two-level lip similar to the lip 46.

As shown in FIG. 1, the lower intermediate section 16 has a side wall 56 in which an inlet opening 58 has been formed. The inlet opening 58 may be approximately circular as shown, or may be formed in any other suitable shape, and there may be multiple openings. In the illustrated implementation, the inlet opening 58 is formed sufficiently large to allow a wastewater inlet pipe 60 to be inserted through the inlet opening into the interior of the well 12. (In certain applications, more than one inlet opening 58 may be required.)

The upper intermediate well section 18, which is also a hollow cylinder, has a side wall 62 in which two outlet openings 64 have been formed, one of which can be seen in FIG. 1. The second opening is usually formed at the same height, but may be formed at a different height if required. As in the case of the inlet opening 58, the outlet openings 64 may be circular as shown, or may be formed in any other suitable shape. In the illustrated implementation, the outlet openings 64 are formed sufficiently large to receive respective wastewater outlet pipes 66.

The inlet opening 58 and the outlet openings 64 may be formed, e.g., by a boring operation in each respective well section after it has been formed and cured. These openings, as well as the valve vault openings described below, are typically formed to be slightly larger than the respective outer diameters of the pipes received therein, with the remaining space surrounding the pipes being filled by a pipe boot or similar arrangement (e.g., a KOR-N-SEAL, which is a surrounding rubber seal expandable by turning a screw) to create a watertight connection. A representative pipe boot 65 is shown filling the space between the outlet opening 64 shown in FIG. 1 and an outlet pipe 65.

In the illustrated example, the well 12 includes two intermediate well sections 16, 18. In other applications, there may be only one or more than two intermediate well sections. Also, the inlet opening(s) 58 and the outlet opening (s) 64 may be formed in a single well section, or in separate well sections. Further, there may be intermediate well sections formed without any inlet or outlet openings.

Figure 5:
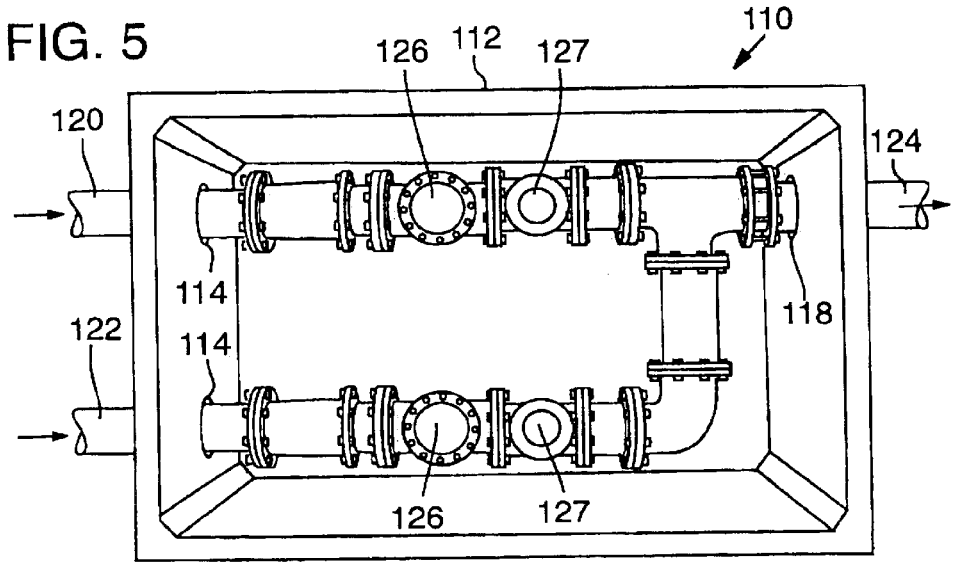
FIG. 5 is a top perspective view showing a utility vault suited for use with the lift station assembly of FIG. 1.

The well section 20, referred to herein as the top cover well section, serves to cover the well 12. The top cover well section 20, which is a generally disk-shaped solid, has an access opening 67 formed therein to provide access to the well 12. As illustrated in FIGS. 1 and 5, the access opening 67 may be generally rectangular. Components used to cover the access opening are described below.

The top cover well section 20 is also pre-formed with a lateral passage 68. As illustrated in FIG. 1, the passage 68 connects a side opening 70 positioned at an outer side surface 72 and a bottom opening 74 in the lower end 54*a* adjacent the access opening 67.

The well sections 14, 16, 18 and 20 are typically pre-cast of 4000 psi concrete. In typical implementations, reinforced concrete is used. Traffic load codes may require the use of reinforced concrete for at least the top cover well section 20. Typically, at least the bottom sump well section 14 has a self-cleaning insert. In the illustrated implementation, the bottom well section has been cast with the insert in place so that the insert forms an integral part of the inner surface 28. Optionally, the intermediate well sections 16 and 18 may also be fitted with similar liners, especially for use in warm and/or marine climates.

Depending upon the desired diameter of the wet well 12, some of the sections described above may be formed as multiple components. For example, to maintain the weight of each section below a desired threshold, e.g., due to handling or transportation concerns, the bottom sump section 14 may be formed as separate upper and lower components (not shown). In such implementations, the upper and lower components may be formed to create a watertight joint as described above for the section-to-section connections.

For modularity, the well sections 14, 16, 18 and 20 are made available in standard diameters, e.g., 60, 72 and 84 inches. Typically, the bottom sump section 14 is formed to have a height of about 36 inches, whereas the intermediate well sections 16 and 18 are formed to have a height of about 60 inches. For the 84 inche diameter implementation the bottom sump 14 may include separate bottom and top components (about 26.75 inches and about 16.375 inches in height, respetively), which are each lower in weight than a single bottom sump section of this size, thus facilitating formation, storage, transportation and installation.

According to ASTM C 478-97, up to five intermediate well sections can be "stacked," thereby providing a well of 25+feet in depth.

Inlet, Pump and Outlet

In a typical installation, called a duplex arrangement, two pumps 78 (one being shown in FIG. 1) are positioned in the well 12 generally within the sump 30.

Suitable types of pump are the C-Pump series or the N-Pump series from ITT Flygt (headquartered in Stockholm, Sweden) in 3 hp to 23 hp sizes. The N-Pump series pumps are submersible pumps with a special self-cleaning impeller suited for reliably moving wastewater that may contain fibrous material.

An outlet side of each pump 78 is connected to the respective outlet pipe 66 at its lower end, e.g., at an elbow 82. As illustrated in FIG. 1, an inlet side 79 is positioned downwardly to draw wastewater into the pump 78 from below. From the elbow 82, the outlet pipes 66 lead upward and out of the well 12 through the respective outlet openings 64. Each elbow 82 is rigidly attached to an elbow bracket 83 attached to the sump 30.

In FIG. 3, the relative side-by-side positions of the two pumps 78 in the duplex arrangement can be seen. As also shown in FIG. 3, the elbows 82 can be pre-attached to the brackets 83, which are attached with fasteners pre-formed in the bottom surface 32. By accurately locating the fasteners and brackets 83 upon formation of the bottom sump section, proper alignment of the pump and pump rail is facilitated.

One or both of the pumps 78 may have a coupler 84 that allows it to be automatically engaged with and sealed against the elbow 82 upon being lowered into place by an operator O using a winch 85 as shown in FIG. 1. In the same way, the pump 78 can also be disengaged for servicing or replacement. As illustrated in FIG. 1, a guide rail 86 may be positioned vertically within the well 12 and slidingly engaged with the pump 78 to assist in raising and lowering it.

Adjacent the inlet opening 58, a deflector 87 may be attached to an inner surface 89 of the well 12 to shield the pump 78 from the direct flow of wastewater entering through the inlet opening 58. As illustrated in FIG. 1, the deflector 87, which is generally flat and rectangular in shape, is attached with fasteners arranged in two spaced vertical rows along the inner surface 89. When viewed from above, the deflector 87 resembles a chord of the generally circular inner periphery of the well 12.

A "guillotine" panel 90, which can be raised or lowered by the operator O using the cable 92, is positioned between the deflector 87 and the inner surface 89. When the panel 90 is raised (shown partially raised in FIG. 1), the inlet opening 58 and inlet pipe 60 can be viewed through an inspection opening 88 formed in the deflector 87.

The deflector 87 and the panel 90 may be made of a plastic such as HDPE. The deflector 87 and the panel 90 prevent the pump 78 from cavitation damage and reduce off-gassing.

Control of the Pump

As illustrated in FIG. 1, a level sensor 94 is positioned within the well to assist in controlling operation of the pump 78. One suitable level sensor 94 is the Liquid Level Sensing Probe available from Multitrode of Australia. The level sensor 94 may have indicia to allow the operator to confirm the level of wastewater within the well 12 visually.

The sensor 94 has a sensor cable 95 through which AC power is provided to the sensor 94 and sensor output signals indicative of the sensed wastewater level are transmitted from the sensor 94. The sensor cable 95 is connected to the pump 78 and, optionally, to a remote location, such as a control panel (not shown).

The pump 78 has a power cable 98 through which AC power is supplied to operate the pump 78. The power cable 98 may also be routed through the disconnect box 96 as illustrated in FIG. 1. Power may be supplied from any suitable source, including an on-site electric generator.

In automatic operation, when the wastewater within the well 12 reaches an upper limit U as sensed by the level sensor 94, one or both of the pumps 78 are selectively triggered to begin operation and evacuate the wastewater. The pump 78 continues to operate until the wastewater decreases below a lower level L as sensed by the level sensor 94, at which point the pump 78 is controlled to cease operation. The level sensor 94 may have indicia to allow the operator to visually check the level of wastewater within the well 12.

Disconnect Box and Passageway

The passageway 68 in the top cover well section 20 serves to vent gases from the well 12 and as a channel through which the sensor cable 95 and/or the power cable 98 can be routed to an above ground location, e.g., a disconnect box 96. Because the passageway 68 is pre-formed, no on-site fabrication time is required. Routing of the cables is simplified if sharp corners are avoided. Gases in the passageway 68 are vented through openings in a steel grate 102 in the upper end 54*b* of the top cover well section.

The disconnect box 96 can be positioned on a stand 97 to provide convenient above-ground access to the sensor and pump electrical connections. In typical implementations, the disconnect box 96 is at least about 2 feet above ground, which permits standard electrical connections to be used, as opposed to the special explosion-proof connections that must be used within the well. In typical installations, the electrical connections are configured as plug-type connections, such as the quick-disconnect couplings 103, that can be connected and disconnected by hand, and without requiring personnel with a special certification (e.g., an electrician).

As shown in FIG. 1, the stand 97 can be secured with fasteners (e.g., stainless steel bolts) that are pre-set in the top cover well section 20. The stand 97 is shaped to allow the sensor cable 95 and the power cable 98 to be routed through it, and thus provides an improved appearance and increased protection against weather and the elements.

When the couplings 103 are disconnected, the cables 95 and 98 can be easily withdrawn through the passageway 68, which is formed without sharp corners. The disconnect box 96 is fitted with a weather-proof and locking cover.

In typical installations, the disconnect box has a connection to a conventional control panel (not shown) through which level sensor signals and pump signals are sent for monitoring and/or control. The pumps signals may include a moisture sensor signal and/or a heat signal.

Access Opening

Figure 4:
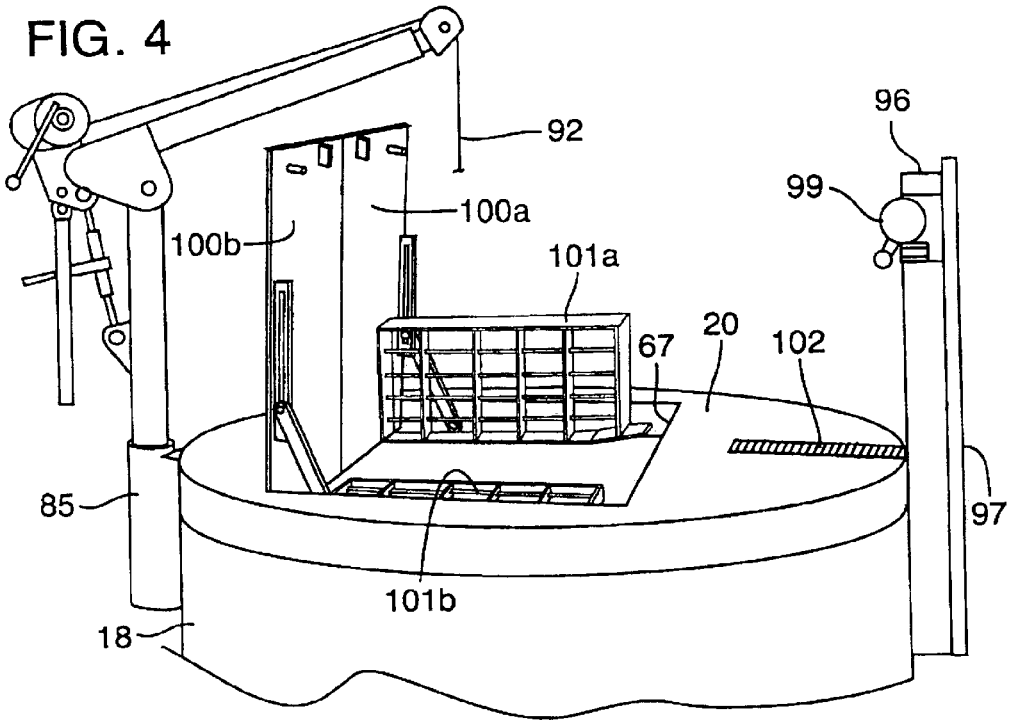
FIG. 4 is partial oblique view of a top portion of the lift station assembly of FIG. 1.

As illustrated in FIGS. 1 and 4, the access opening 67 in the top cover well section is sized to receive a cover member or cover member assembly. In the illustrated implementation, the access opening 67 receives grates 101*a*, 101*b* and respective overlying solid covers 100*a*, 100*b*. The grates 100*a*, 100*b* and the covers 1*a*, 100*b* are each hingedly attached to a side of the access opening 67.

As best shown in FIG. 4, the grates 100*a*, 100*b* and covers 100*a*, 100*b* are each sized to cover about half of the access opening 67. In this way, with fall protection for the operator in mind, only as much of the access opening 67 as is required to conduct a given task is exposed. For example, removal of a pump may require opening both covers 100*a*, 100*b* but only one of the grates 101*a*, 101*b*, as shown in FIG. 4. Thus, the operator can stand on the grate 101*b* and/or set the removed pump on this grate to allow it to drain. During normal operation, the covers 100*a*, 100*b* and the gates 101*a*, 101*b* remain closed to seal the well 12.

The access opening 67 can also be pre-formed with a guide rail receiving channel 104 (e.g., a nut rail) for the guide rail 86 and cable hangers 106. The channel 104 allows the positions of the guide rail 86 and cable hangers 106 to be changed easily, in aligning the guide rail.

Valve Vault

As shown in FIG. 5, a preassembled utility vault 110 conveniently accompanies the lift station 10 to connect each outlet pipe 66 with downstream pipes, e.g., leading to a sewer main. Because the contents of the vault 110 are pre-assembled, on site installation requires only that three pipes be joined to the vault 110.

The valve vault 110 is configured for a lift station having a duplex pump arrangement and two outlet pipes 66. At one end of the valve vault 110, one of the outlet pipes 66 is joined to a pipe section 120, and the other of the outlet pipes is joined to a pipe section 122. A pipe section 124, which protrudes from the opposite end of the valve fault 110, is joined to a downstream delivery pipe, e.g., a forced main.

Each of the pipe sections 120, 122 is connected to a plug valve 126 (allowing the respective pump to be isolated in the event of a problem or for maintenance) and a check valve 127 (preventing downstream back pressure from causing a reverse flow from entering the well 12 through the outlet pipe 66) before being joined together at a T-fitting leading to the pipe section 124.

The vault 110 has a precast concrete shell and is formed with openings 114 and 118 for the pipe sections 120, 122 and 124. In specific implementations, the pipe sections 120, 122, 124 can be formed of ductile iron in 4" or 6" diameters.

The valve vault 110 may be provided with access doors (not shown) to prevent unauthorized access and intrusion by the elements. A drain may also be provided in a lower surface of the valve vault 110.

Installation

The well sections 14, 16, 18 and 20 may each have indicia (not shown), such as vertical line or a cast notch painted with a visible color, on its outer surface to allow it to be aligned with adjacent well sections during installation. In certain embodiments, top and bottom portions of adjacent well sections may be fitted with a tongue and groove respectively (not shown), or some other keying system provided to facilitate alignment.

In embodiments with the inlet opening 58 and the outlet opening 64 formed in different well sections, the well section with the outlet opening 64 can be rotated relative to the well section with the inlet opening 58, e.g., if necessary to improve the alignment of the openings with their respective pipes. Such an adjustment would not be possible with a conventional one-piece well.

The well sections and other components are transported to the site, typically by a conventional truck in a single delivery. If a suitable hole for the well 12 has been excavated, assembly of the lift station 10 proceeds with lowering of the bottom sump well section 14 into place, followed by the successive alignment and placement of each required intermediate well section. The pipes are routed as required, and then the top cover well section is placed. Thereafter, the other components, including the pump, pump rail, pump and level sensor cables, etc., are configured. The completed lift station 10 is usually configured to have the upper end 54*b* at a level of about 12 in. above the surrounding ground.

Having illustrated and described the principles of the invention in exemplary embodiments, it should be apparent to those skilled in the art that the illustrative embodiments can be modified in arrangement and detail without departing from such principles. In view of the many possible embodiments to which the principles of the invention can be applied, it should be understood that the illustrative embodiments are intended to teach these principles and are not intended to be a limitation on the scope of the invention. We therefore claim as our invention all that comes within the scope and spirit of the following claims and their equivalents.

We claim:

1. A method of configuring electrical connections for a wastewater lift station, comprising:

providing an electrically-powered apparatus that is positioned within the wastewater lift station at a level below ground level;

providing at least one electrical cable connected at a first end to the apparatus, the cable having a second end fitted with a quick-disconnect coupling;

passing the second end of the cable through a cable routing passage to a terminal location, the terminal location being positioned outside the wastewater lift station and at a level spaced above ground level and having a mating quick-disconnect coupling; and connecting the quick disconnect coupling to a mating quick disconnect coupling connector.

2. A cover assembly for a wastewater lift station, comprising:

a cover having first and second opposing major surfaces and at least one outer side surface, the cover having a lift station access opening defined therein and extending through the major surfaces; and a preformed channel defined in the cover and extending from an inner end at the first major surface to an outer end at the at least one outer side surface, the channel having at least one vent opening extending from the channel to the second major surface.

3. The cover assembly of claim 2, further comprising an upright member through which a cable from the channel can be routed, the upright member having a lower end positionable in alignment with the outer end of the channel and an opposite upper end positionable at a level above the second major surface of the cover.

4. The cover assembly of claim 3, wherein the upright member has an interior cable routing area through which the cable can be routed.

5. The cover assembly of claim 4, wherein the upright member has a locking access portion that can be unlocked to provide access to the cable routing area.

6. The cover assembly of claim 3, further comprising an operator access box adapted for mounting to an upper end of the upright member, the operator access box housing a connector for connecting the cable to a source of AC power.

7. The cover assembly of claim 6, wherein the operator access box is mounted at least 18 inches above ground level.

8. A cover assembly for a wastewater lift station, comprising:

a cover having opposing major surfaces and at least one outer side surface, the cover having a lift station access opening defined therein and extending through the major surfaces; and a channel defined in the cover and extending from an inner end that opens to an interior of the lift station to an outer end adjacent the outer side surface that opens to an exterior of the lift station, the channel providing for venting of gases through openings in a grate in one of the major surfaces of the cover.

9. The cover assembly of claim 8, wherein the grate has an outer end positioned adjacent the outer side surface of the cover.

10. The cover assembly of claim 9, further comprising an upright member through which one or more cables from the channel can be routed, the upright member having a lower end positionable in alignment with the outer end of the channel and over the outer end of the grate, the upright member having an access door that can be opened to allow the grate to be removed.

11. The cover assembly of claim 9, wherein the grate has an inner end opposite the outer end, and wherein the inner end is engageable with a groove formed in the adjacent one of the major surfaces to secure the grate.

12. The cover assembly of claim 8, wherein the inner end of the channel is positioned adjacent the lift station access opening.

13. A cable routing construction for a wastewater lift station, the construction comprising:

a channel extending generally laterally through an upper region of the lift station and at least partially comprising a preformed insert, the channel having an inner end opening to an interior of the lift station and an outer end opening to an exterior of the lift station, the channel defining a passage dimensioned to receive a cable and allowing gases to be vented from the interior.

14. The construction of claim 13, wherein the channel has a top portion with vent openings extending from the passage to the exterior of the lift station.

15. The construction of claim 13, wherein the channel is preformed in a top section of the lift station.

16. The construction of claim 15, wherein the inner end of the channel that opens to the interior of the lift station is positioned at the lower surface of the of the top section, the outer end of the channel that opens to the exterior of the lift station is positioned at an outer side surface of the top section, and the channel extends from the inner end, bends toward the outer side surface and extends generally laterally to the outer end.

17. The construction of claim 13, wherein the channel is dimensioned to allow movement through the channel of the cable and a connector fitted to an end of the cable.

* * * * *

UNITED STATES PATENT AND TRADEMARK OFFICE

CERTIFICATE OF CORRECTION

PATENT NO. : 6,772,782 B2
DATED : August 10, 2004
INVENTOR(S) : Bogan et al.

It is certified that error appears in the above-identified patent and that said Letters Patent is hereby corrected as shown below:

Column 5,
Line 16, "inche" should read -- inch --.
Line 17, "sump 14" should read -- sump section 14 --.

Signed and Sealed this

First Day of November, 2005

JON W. DUDAS
*Director of the United States Patent and Trademark Office*